United States Patent [19]

Purgavie

[11] Patent Number: 4,812,106

[45] Date of Patent: Mar. 14, 1989

[54] VARIABLE STATOR VANE ARRANGEMENT FOR A COMPRESSOR

[75] Inventor: Duncan G. Purgavie, Derby, England

[73] Assignee: Rolls-Royce plc, London, England

[21] Appl. No.: 187,027

[22] Filed: Apr. 27, 1988

[30] Foreign Application Priority Data

Jun. 30, 1987 [GB] United Kingdom ..... 8715314

[51] Int. Cl.[4] ..... F01D 9/04; F01D 17/16; F01D 25/28

[52] U.S. Cl. ..... 415/139; 415/160

[58] Field of Search ..... 415/160, 162, 159, 177, 415/139; 60/39, 32

[56] References Cited

U.S. PATENT DOCUMENTS 2,933,234 4/1960 Neumann ..... 415/160
3,994,620 11/1976 Spraker, Jr. et al. ..... 415/145
4,502,836 3/1985 Swearingen ..... 415/150

FOREIGN PATENT DOCUMENTS 1313938 4/1973 United Kingdom .
1499531 2/1978 United Kingdom .
1513688 6/1978 United Kingdom .

*Primary Examiner*—Robert E. Garrett
*Assistant Examiner*—Michael V. Readey
*Attorney, Agent, or Firm*—Cushman, Darby & Cushman

[57] ABSTRACT

Variable stator vane arrangements for compressors of gas turbine engines suffer from errors in the angular position of the variable stator vanes because of relative movement between the stator casing and control ring which is allowed by a clearance between the stator casing and control ring. A plurality of pieces of material which have a relatively high coefficient of expansion are arranged circumferentially and are positioned radially between the control ring and the stator casing. The pieces of material control the effective clearance between the control ring and the stator casing so that the error of the variable stator vane angular position is minimized. The pieces of material may be formed from a polyimide resin or high coefficient of expansion steel, and may be positioned in housings which are secured to the control ring.

7 Claims, 2 Drawing Sheets

VARIABLE STATOR VANE ARRANGEMENT FOR A COMPRESSOR

The present invention relates to variable stator vane arrangements for compressors, particularly axial flow compressors for gas turbine engines.

The compressors of gas turbine engines are generally provided with variable stator vanes, especially compressors which have relatively high pressure ratios, to ensure that the compressor will operate efficiently over its full speed range. The variable stator vanes are used to correct the angle of incidence of the air onto a stage of rotor blades to angles which they can tolerate without a break down of flow, stall or surge at relatively low compressor pressure ratios and compressor rotor speeds.

A variable stator vane's angular position is controlled by an operating lever, which is connected to a control ring positioned coaxially with the stator casing.

It is desirable to have as small a radial clearance between the stator casing and the control ring in order to minimise error or discrepancy of stator vane angular position. In operation the stator casing temperature is lower than the temperature of the air surrounding the stator casing, and in which is located the control ring.

The control ring therefore expands more than the stator casing, increasing the clearance between the control ring and stator casing and therefore increasing the error or discrepancy in the stator vane angular position.

Accordingly the present invention seeks to provide a variable stator vane arrangement for an axial flow compressor in which the error or discrepancy of the stator vane angular position is minimised.

Accordingly the present invention provides a variable stator vane arrangement for an axial flow compressor comprising a plurality of circumferentially spaced apart radially extending variable stator vanes, each variable stator vane being rotatably mounted on a stator casing, a control ring surrounding and arranged coaxially with the stator casing, each variable stator vane being connected to the control ring by an operating lever, the control ring being spaced radially from the stator casing by a clearance, a plurality of pieces of material being arranged circumferentially and positioned radially between the control ring and the stator casing, the plurality of pieces of material having a relatively high coefficient of expansion to control said clearance between the control ring and the stator casing whereby the error of the variable stator vane angular position is reduced.

The plurality of pieces of material may be arranged circumferentially on the control ring, the plurality of pieces of material extending radially inwardly from the control ring towards the stator casing.

Each of the plurality of pieces of material may be positioned in a respective housing, the housings being removably secured to the control ring.

The plurality of pieces of material may be spaced radially from the stator casing by a predetermined clearance.

The plurality of pieces of material may be equispaced circumferentially.

The plurality of pieces of material may be formed from a polyimide resin, or a high coefficient of expansion steel.

The present invention will be more fully explained, by way of example, with reference to the accompanying drawings, in which.

Figure 1:
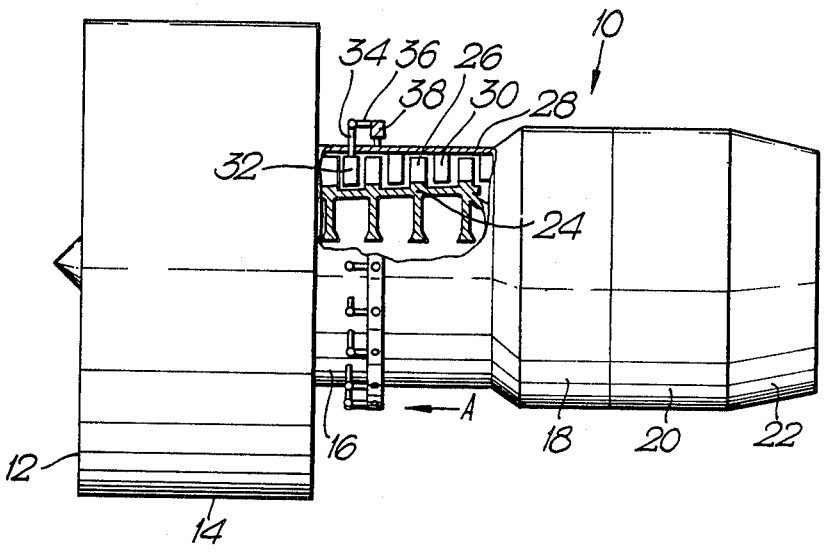
FIG. 1 is a partially cut away view of a gas turbine engine showing a variable stator vane arrangement for an axial flow compressor according to the present invention.

A turbofan gas turbine engine 10 is shown in FIG. 1, and comprises in axial flow series a fan section 14 which has an intake 12 at its upstream end, a compressor section 16, a combustion system 18, a turbine section 20 and an exhaust nozzle 22. The turbofan gas turbine engine 10 operates quite conventionally in that air is taken in through the intake 12, the air is compressed by the fan 14 and compressor 16 and supplied to the combustion system 18. Fuel is injected into, and burnt in, the combustion system 18 to produce hot gases which flow through and drive the turbines in the turbine section 20 before flowing through the exhaust nozzle 22 to atmosphere. The turbines in turn drive the fan 14 and compressor 16 via shafts (not shown).

The compressor 16 comprises a rotor 24, which has a plurality of axially spaced stages of rotor blades 26. The rotor blades 26 in each stage are circumferentially arranged, and extend radially outwards from the rotor 24. A stator casing 28 is arranged coaxially with, and surrounds, the rotor 24, the stator casing being spaced radially from the rotor blades by a small tip clearance. The stator casing 28 has a plurality of axially spaced stages of stator vanes 30, the stator vanes 30 in each stage are arranged circumferentially and extend radially inwards from the stator casing 28.

The stages of rotor blades and stator vanes are arranged axially alternately.

One of the stages of stator vanes, at the upstream end of the compressor, comprises variable stator vanes 32, each of which is rotatably mounted on the stator casing 28. The variable stator vanes 32 have spindles 34 at their radially outer ends which extend radially through respective apertures in the stator casing 28, to rotatably mount the variable stator vanes 32 on the stator casing 28.

Figure 3:
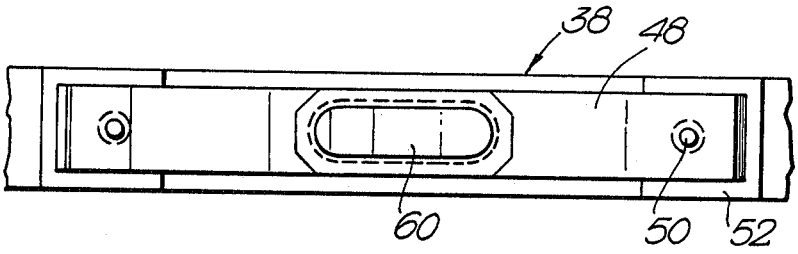
FIG. 3 is a view in the direction of arrow B in FIG. 2.
Figure 2:
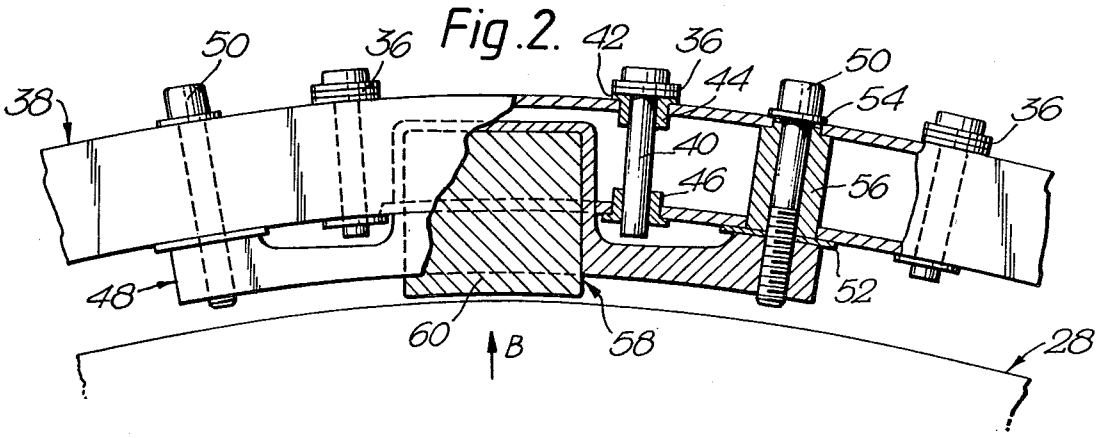
FIG. 2 is an enlarged partially cut away view of the variable stator vane arrangement in the direction of arrow A in FIG. 1.

A control ring 38 as shown partially in FIGS. 2 and 3 is arranged coaxially with, and surrounds, the stator casing 28, and each variable stator vane 32 is connected to the control ring 38 by an operating lever 36. The operating levers 36 are rotatably mounted on the control ring 38 by radially extending spindles 40, which extend through apertures 42 in the control ring 38, and bushes 44 and 46 are provided between the spindles 40 and control ring 38 in the apertures 42.

The control ring 38 is spaced radially from the stator casing 28 by a clearance, and has a plurality of circumferentially arranged housing members 48 which are removably secured to the control ring 38 by bolts 50, which extend radially through apertures 54 in the control ring 38. Bushes 56 are provided in the control ring 38 to receive the bolts 50, and spacers 52 are positioned between the control ring 38 and the housing member 48. The housing members 58 are positioned radially on the inner side of the control ring 38, and each housing member 48 has a recess 58 to receive a piece of material 60 which has a high coefficient of expansion. The pieces of material 60 extend radially inwards from the recesses 58 in the housing members 48 and protrude radially therefrom, and are arranged to form a relatively small initial clearance with the stator casing 28.

The stator casing and control ring are for example constructed of titanium, and the pieces of material of high coefficient of expansion are steels with a high coefficient of expansion or preferably are a polyimide resin sold under the Trade name VESPEL by the Du Pont Company, although any suitable material with a high coefficient of expansion may be used, i.e. higher than that of titanium or higher than that of any material from which the stator casing and control ring is made.

The control ring 38 is rotatably mounted on the stator casing 28, and the control ring 38 is rotated by a ram (not shown) in order to vary the angular position of the variable stator vanes 32.

The variable stator vanes 32 are used to correct the angle of incidence of the air onto the downstream stage of rotor blades to angles of incidence which the rotor blades can tolerate without break down of flow, stall or surge at relatively low compressor pressure ratios and compressor rotor speeds.

Figure 4:
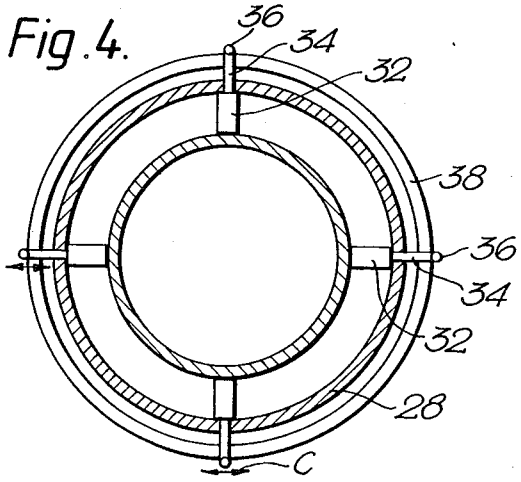
FIG. 4 is a diagrammatical section through a prior art variable stator vane arrangement.

The clearance between the stator casing 28 and the control ring 38 should be as small as possible to minimise the error or discrepancy of stator vanes angular position. The clearance between the stator casing 28 and the control ring 38 in the prior art arrangement allows relative movement, as shown in FIG. 4 for example by arrows C, and any relative movement between the two from a coaxial position will produce variations or errors in the angular positions of the variable stator vanes 32 from the desired angular position. The relative movement does not produce a uniform variation or error in the angular positions from the desired angular position, but rather there is a range of variations from a zero variation to a maximum variation. There are two diametrically opposite positions of substantially zero error, i.e. the stator vanes on the horizontal plane in this example, and two diametrically opposite positions of maximum error, i.e. the stator vanes on the vertical plane in this example. The greater the clearance between the stator casing 28 and the control ring 38 the greater the possible variation or error in the angular position of the variable stator vanes 32.

In operation of the gas turbine engine 10 the air flowing through the compressor 16 increases in temperature as it flows axially in a downstream direction, and therefore the stator casing 28 temperature at the upstream end is less than that at the downstream end. The control ring 38 is positioned in air at a relatively higher temperature than the upstream end of the stator casing 28. The control ring 38 therefore expands more than the upstream end of the stator casing 28, in which is positioned the variable stator vanes 32, and thus the clearance between the stator casing 28 and control ring 38 increases allowing increased variation in the variable stator vane 32 angular position.

The increase in clearance between the stator casing 28 and the control ring 38 is compensated for by the use of the pieces 60 of high coefficient of expansion material which expand radially inwards as the control ring 38 expands radially outwards to minimise the effective clearance between the stator casing 28 and the control ring 38 and in turn reduce the discrepancy, variation or error in the angular position of the variable stator vanes 32.

The pieces 60 of high coefficient of expansion material also prevent reduced clearances and binding between the stator casing 28 and control ring 38 at relatively low temperatures.

A compressor may have a plurality of stages of variable stator vanes, and the principle of using the pieces of material of high coefficient of expansion may be used on all these stages of variable stator vanes.

Although the embodiment has shown the use of pieces of material of high coefficient of expansion being positioned on the control ring, it could be possible to position the pieces of material of high coefficient of expansion on the stator casing, but corresponding changes to the initial clearance between the pieces and the control ring will be necessary and the dimensions of the pieces will be changed to allow for the axial upstream and downstream movement of the control ring as the angle of the variable stator vanes is changed.

I claim:

1. A variable stator vane arrangement for an axial flow compressor comprising a stator casing, a plurality of variable stator vanes, a control ring, a plurality of operating levers, and a plurality of pieces of material, the variable stator vanes being circumferentially spaced apart and extending radially, each variable stator vane being rotatably mounted on the stator casing, the control ring surrounding and being arranged coaxially with the stator casing, each variable stator vane being connected to the control ring by one of the plurality of operating levers, the control ring being spaced radially from the stator casing by a clearance, the pieces of material being arranged circumferentially and being positioned radially between the control ring and the stator casing, the pieces of material having a relatively high coefficient of expansion to control the clearance between the control ring and the stator casing whereby any error of the variable stator vane angular position is reduced.

2. A variable stator vane arrangement for an axial flow compressor as claimed in claim 1 in which the plurality of pieces of material are arranged circumferentially on the control ring, the plurality of pieces of material extending radially inwardly from the control ring towards the stator casing.

3. A variable stator vane arrangement for an axial flow compressor as claimed in claim 2 comprising a plurality of housings, each of the plurality of pieces of material is positioned in a respective one of the housings, the housings being removably secured to the control ring.

4. A variable stator vane arrangement for an axial flow compressor as claimed in claim 2 in which the plurality of pieces of material are spaced radially from the stator casing by a predetermined clearance.

5. A variable stator vane arrangement for an axial flow compressor as claimed in claim 1 in which the plurality of pieces of material are equi-spaced circumferentially.

6. A variable stator vane arrangement for an axial flow compressor as claimed in claim 1 in which the plurality of pieces of material are formed from a polyimide resin.

7. A variable stator vane arrangement for an axial flow compressor as claimed in claim 1 in which the plurality of pieces of material are formed from a high coefficient of expansion steel.

* * * * *